US008295493B2

(12) United States Patent
Faller

(10) Patent No.: US 8,295,493 B2
(45) Date of Patent: Oct. 23, 2012

(54) METHOD TO GENERATE MULTI-CHANNEL AUDIO SIGNAL FROM STEREO SIGNALS

(75) Inventor: Christof Faller, Chavannes-pres-Renens (CH)

(73) Assignee: LG Electronics Inc., Seoul (KR)

( * ) Notice: Subject to any disclaimer, the term of this patent is extended or adjusted under 35 U.S.C. 154(b) by 1083 days.

(21) Appl. No.: 12/065,502

(22) PCT Filed: Sep. 1, 2006

(86) PCT No.: PCT/EP2006/065939

§ 371 (c)(1),
(2), (4) Date: Jun. 9, 2008

(87) PCT Pub. No.: WO2007/026025

PCT Pub. Date: Mar. 8, 2007

(65) Prior Publication Data

US 2008/0267413 A1 Oct. 30, 2008

(30) Foreign Application Priority Data

Sep. 2, 2005 (EP) ..... 05108078

(51) Int. Cl.
*H04R 5/00* (2006.01)

(52) U.S. Cl. ..... 381/1; 381/17; 381/18; 704/500; 704/501; 704/200.1

(58) Field of Classification Search ..... 381/1, 17–18, 381/22–23; 704/500–501, 200, 200.1
See application file for complete search history.

(56) References Cited

U.S. PATENT DOCUMENTS

| | | | | |
|---|---|---|---|---|
| 2005/0157883 | A1 | 7/2005 | Herre et al. | |
| 2005/0180579 | A1 * | 8/2005 | Baumgarte et al. | 381/63 |
| 2006/0085200 | A1 * | 4/2006 | Allamanche et al. | 704/500 |

FOREIGN PATENT DOCUMENTS

| | | |
|---|---|---|
| WO | 01/62045 | 8/2001 |
| WO | 2004/019656 | 3/2004 |
| WO | 2004/093494 | 10/2004 |

OTHER PUBLICATIONS

European Search Report & Written Opinion for Application No. EP 05108078, dated Mar. 13, 2006, 5 pages.

* cited by examiner

*Primary Examiner* — Disler Paul
(74) *Attorney, Agent, or Firm* — Fish & Richardson P.C.

(57) ABSTRACT

An exemplary embodiment of the invention can generate multiple output audio signals from multiple input audio signals, in which the number of output signals is equal to or higher than the number of input signals. The embodiment includes computing one or more independent sound subbands representing signal components which are independent between the input subbands; computing one or more localized direct sound subbands representing signal components which are contained in more than one of the input subbands and direction factors representing the ratios with which these signal components are contained in two or more input subbands; generating the output subband signals, where each output subband signal is a linear combination of the independent sound subbands and the localized direct sound subbands; and converting the output subband signals to time domain audio signals.

22 Claims, 7 Drawing Sheets

METHOD TO GENERATE MULTI-CHANNEL AUDIO SIGNAL FROM STEREO SIGNALS

Many innovations beyond two-channel stereo have failed because of cost, impracticability (e.g. number of loudspeakers), and last but not least a requirement for backwards compatibility. While 5.1 surround multi-channel audio systems are being adopted widely by consumers, also this system is compromised in terms of number of loudspeakers and with a backwards compatibility restriction (the front left and right loudspeakers are located at the same angles as in two-channel stereo, i.e. +/−30°, resulting in a narrow frontal virtual sound stage).

It is a fact that by far most audio content is available in the two-channel stereo format. For audio systems enhancing the sound experience beyond stereo, it is thus crucial that stereo audio content can be played back, desirably with an improved experience compared to the legacy systems.

It has long been realized that the use of more front loudspeakers improves the virtual sound stage also for listeners not exactly located in the sweet spot. There has been the aim of playing back stereo signals over more than two loudspeakers for improved results. Especially, there has been a lot of attention on playing back stereo signals with an additional center loudspeaker. However, the improvement of these techniques over conventional stereo playback has not been clear enough that they would have been widely used. The main limitations of these techniques are that they only consider localization and not explicitly other aspects such as ambience and listener envelopment. Further, the localization theory behind these techniques is based a one-virtual-source-scenario, limiting their performance when a number of sources are present at different directions simultaneously.

These weaknesses are overcome by the techniques proposed in this description by using a perceptually motivated spatial decomposition of stereo audio signals. Given this decomposition, audio signals can be rendered for an increased number of loudspeakers, loudspeaker line arrays, and wavefield synthesis systems.

The proposed techniques are not limited for conversion of (two channel) stereo signals to audio signals with more channels. But generally, a signal with L channels can be converted to a signal with M channels. The signals can either be stereo or multi-channel audio signals aimed for playback, or they can be raw microphone signals or linear combinations of microphone signals. It is also shown how the technique is applied to microphone signals (a.g. Ambisonics B-format) and matrixed surround downmix signals for reproducing these over various loudspeaker setups.

When we refer to a stereo or multi-channel audio signal with a number of channels, we mean the same as when we refer to a number of (mono) audio signals.

SUMMARY OF THE INVENTION

According to the main embodiment applying to multiple audio signals, it is proposed to generate multiple output audio signals ($y_1, \ldots, y_M$) from multiple input audio signals ($x_1, \ldots, x_L$), in which the number of output is equal or higher than the number of input signals, this method comprising the steps of:

by means of linear combinations of the input subbands $X_1(i), \ldots, X_L(i)$, computing one or more independent sound subbands representing signal components which are independent between the input subbands, by means of linear combinations of the input subbands $X_1(i), \ldots, X_L(i)$, computing one or more localized direct sound subbands representing signal components which are contained in more than one of the input subbands and direction factors representing the ratios with which these signal components are contained in two or more input subbands, generating the output subband signals, $Y_1(i) \ldots Y_M(i)$, where each output subband signal is a linear combination of the independent sound subbands and the localized direct sound subbands converting the output subband signals, $Y_1(i) \ldots Y_M(i)$, to time domain audio signals, $y_1 \ldots y_M$.

The index i is the index of the subband considered. According to a first embodiment, this method can be used with only one subband per audio channel, even if more subbands per channel give a better acoustic result.

The proposed scheme is based on the following reasoning. A number of input audio signals $x_1, \ldots, x_L$ are decomposed into signal components representing sound which is independent between the audio channels and signal components which represent sound which is correlated between the audio channels. This is motivated by the different perceptual effect these two types of signal components have. The independent signal components represent information on source width, listener envelopment, and ambience and the correlated (dependent) signal components represent the localization of auditory events or acoustically the direct sound. To each correlated signal component there is associated directional information which can be represented by the ratios with which this sound is contained in a number of audio input signals. Given this decomposition, a number of audio output signals can be generated with the aim of reproducing a specific auditory spatial image when played back over loudspeakers (or headphones). The correlated signal components are rendered to the output signals ($y_1, \ldots, y_M$) such that it is perceived by a listener from a desired direction. The independent signal components are rendered to the output signals (loudspeakers) such that it mimics non-direct sound and its desired perceptual effect. This functionality, described on a high level, is taking the spatial information from the input audio signals and transforming this spatial information to spatial information in the output channels with desired properties.

BRIEF DESCRIPTION OF THE DRAWINGS

The invention will be better understood thanks to the attached drawings in which.

DETAILED DESCRIPTION OF THE INVENTION

Spatial Hearing and Stereo Loudspeaker Playback

The proposed scheme is motivated an described for the important case of two input channels (stereo audio input) and M audio output channels (M≧2). Later, it is described how to apply the same reasoning as derived at the example of stereo input signals to the more general case of L input channels.

Figure 1:
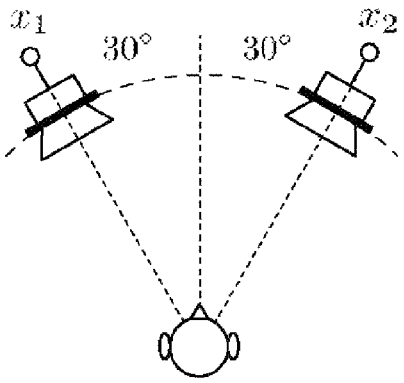
FIG. 1 shows a standard stereo loudspeaker setup.

The most commonly used consumer playback system for spatial audio is the stereo loudspeaker setup as shown in FIG. 1. Two loudspeakers are placed in front on the left and right sides of the listener. Usually, these loudspeakers are placed on a circle at angles −30° and +30°. The width of the auditory spatial image that is perceived when listening to such a stereo playback system is limited approximately to the area between and behind the two loudspeakers.

The perceived auditory spatial image, in natural listening and when listening to reproduced sound, largely depends on the binaural localization cues, i.e. the interaural time difference (ITD), interaural level difference (ILD), and interaural coherence (IC). Furthermore, it has been shown that the perception of elevation is related to monaural cues.

The ability to produce an auditory spatial image mimicking a sound stage with stereo loudspeaker playback is made possible by the perceptual phenomenon of summing localization, i.e. an auditory event can be made appear at any angle between a loudspeaker pair in front of a listener by controlling the level and/or time difference between the signals given to the loudspeakers. It was Blumlein in the 1930's who recognized the power of this principle and filed his now-famous patent on stereophony. Summing localization is based on the fact that ITD and ILD cues evoked at the ears crudely approximate the dominating cues that would appear if a physical source were located at the direction of the auditory event which appears between the loudspeakers.

Figure 2:
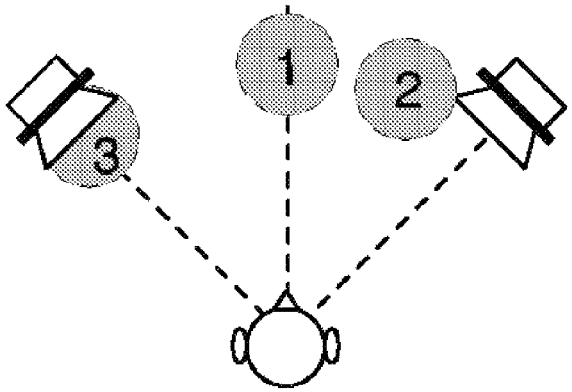
FIG. 2 shows the location of the perceived auditory events for different level differences for two coherent loudspeaker signals, the level and time difference between a pair of coherent loudspeaker signals determining the location of the auditory event which appears between the two loudspeakers, FIG. 3 (*a*) shows early reflections emitted from the side loudspeakers having the effect of widening of the auditory event.

FIG. 2 illustrates the location of the perceived auditory events for different level differences for two coherent loudspeaker signals. When the left and right loudspeaker signals are coherent, have the same level, and no delay difference, an auditory event appears in the center between the two loudspeakers as illustrated by Region 1 in FIG. 2. By increasing the level on one side, e.g. right, the auditory event moves to that side as illustrated by Region 2 in FIG. 2. In the extreme case, when only the signal on the left is active, the auditory event appears at the left loudspeaker position as is illustrated by Region 3 in FIG. 2. The position of the auditory event can be similarly controlled by varying the delay between the loudspeaker signals. The described principle of controlling the location of an auditory event between a loudspeaker pair is also applicable when the loudspeaker pair is not in the front of the listener. However, some restrictions apply for loudspeakers to the sides of a listener.

As illustrated in FIG. 2, summing localization can be used to mimic a scenario where different instruments are located at different directions on a virtual sound stage, i.e. in the region between the two loudspeakers. In the following, it is described how other attributes than localization can be controlled.

Important in concert hall acoustics is the consideration of reflections arriving at the listener from the sides, i.e. lateral reflections. It has been shown that early lateral reflections have the effect of widening the auditory event. The effect of early reflections with delays smaller than about 80 ms is approximately constant and thus a physical measure, denoted lateral fraction, has been defined considering early reflections in this range. The lateral fraction is the ratio of the lateral sound energy to the total sound energy that arrived within the first 80 ms after the arrival of the direct sound and measures the width of the auditory event.

Figure 3:
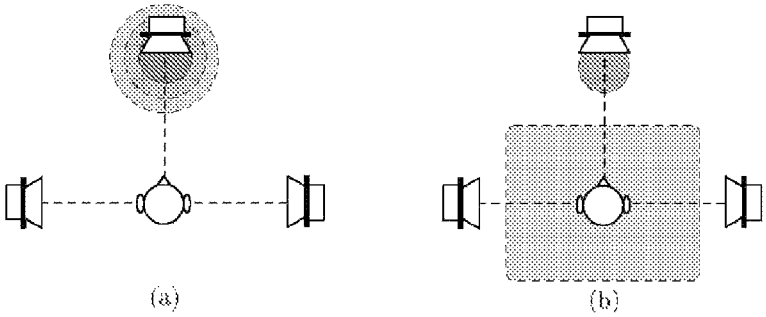
FIG. 3 (*b*) shows late reflections emitted from the side loudspeakers relating more to the environment as listener envelopment.

An experimental setup for emulating early lateral reflections is illustrated in FIG. 3(*a*). The direct sound is emitted from the center loudspeaker while independent early reflections are emitted from the left and right loudspeakers. The width of the auditory event increases as the relative strength of the early lateral reflections is increased.

More than 80 ms after the arrival of the direct sound, lateral reflections tend to contribute more to the perception of the environment than to the auditory event itself. This is manifested in a sense of "envelopment" or "spaciousness of the environment", frequently denoted listener envelopment. A similar measure as the lateral fraction for early reflections is also applicable to late reflections for measuring the degree of listener envelopment. This measure is denoted late lateral energy fraction.

Late lateral reflections can be emulated with a setup as shown in FIG. 3(*b*). The direct sound is emitted from the center loudspeaker while independent late reflections are emitted from the left and right loudspeakers. The sense of listener envelopment increases as the relative strength of the late lateral reflections is increased, while the width of the auditory event is expected to be hardly affected.

Stereo signals are recorded or mixed such that for each source the signal goes coherently into the left and right signal channel with specific directional cues (level difference, time difference) and reflected/reverberated independent signals go into the channels determining auditory event width and listener envelopment cues. It is out of the scope of this description to further discuss mixing and recording techniques.

Spatial Decomposition of Stereo Signals

Figure 4:
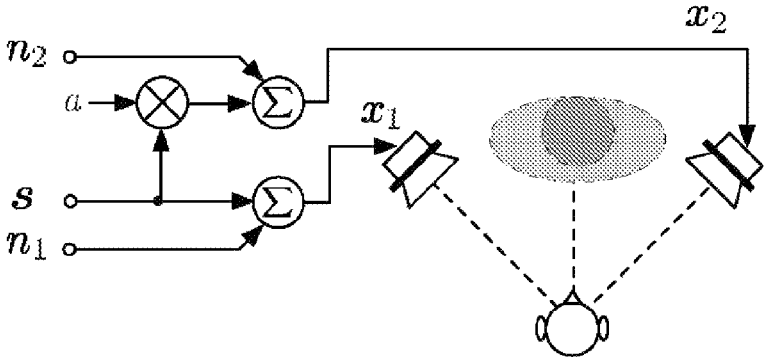
FIG. 4 shows a way to mix a stereo signal mimicking direct sound and lateral reflections.

As opposed to using a direct sound from a real source, as was illustrated in FIG. 3, one can use direct sound corre sponding to a virtual source generated with summing localization. The shaded areas indicate the perceived auditory events. That is, experiments as are shown in FIG. 3 can be carried out with only two loudspeakers. This is illustrated in FIG. 4, where the signal s mimics the direct sound from a direction determined by the factor a. The independent signals, $n_1$ and $n_2$, correspond to the lateral reflections. The described scenario is a natural decomposition for stereo signals with one auditory event, $$x_1(n)=s(n)+n_1(n)x_2(n)=as(n)+n_2(n) \tag{1}$$

capturing the localization and width of the auditory event and listener envelopment.

Figure 5:
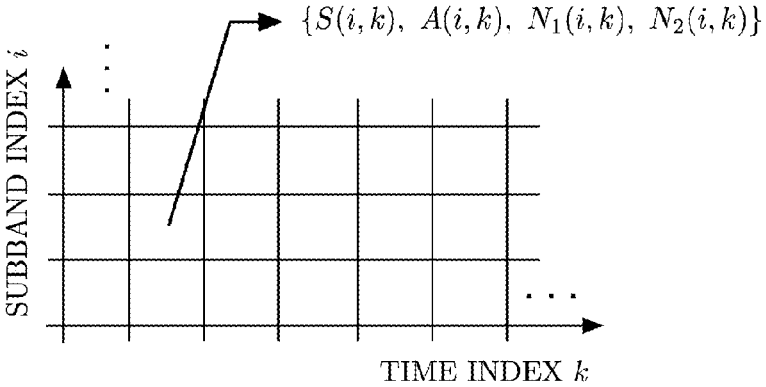
FIG. 5 shows time-frequency tiles representing the decomposition of the signal into subband as a function of time.

In order to get a decomposition which is not only effective in a one auditory event scenario, but non-stationary scenarios with multiple concurrently active sources, the described decomposition is carried out independently in a number of frequency bands and adaptively in time, $$X_1(i,k)=S(i,k)+N_1(i,k)X_2(i,k)=A(i,k)S(i,k)+N_2(i,k) \tag{2}$$

where i is the subband index and k is the subband time index. This is illustrated in FIG. 5, i.e. in each time-frequency tile with indices i and k, the signals S, $N_1$, $N_2$, and direction factor A are estimated independently. For brevity of notation, the subband and time indices are often ignored in the following. We are using a subband decomposition with perceptually motivated subband bandwidths, i.e. the bandwidth of a subband is chosen to be equal to one critical band. S, $N_1$, $N_2$, and direction factor A are estimated approximately every 20 ms in each subband.

Note that more generally one could also consider a time difference of the direct sound in equation (2). That is, one would not only use an direction factor A, but also a direction delay which would be defined as the delay with which S is contained in $X_1$ and $X_2$. In the following description we do not consider such a delay, but it is understood that the analysis can easily be extended to consider such a delay.

Given the stereo subband signals, $X_1$ and $X_2$, the goal is to compute estimates of S, $N_1$, $N_2$, and A. A short-time estimate of the power of $X_1$ is denoted $P_{X_1}(i,k)=E\{X_1^2(i,k)\}$. For the other signals, the same convention is used, i.e. $P_{X_2}$, $P_s$ and $P_N=P_{N_1}=P_{N2}$ are the corresponding short-time power estimates. The power of $N_1$ and $N_2$ is assumed to be the same, i.e. it is assumed that the amount of lateral independent sound is the same for left and right.

Note that other assumptions than $P_N=P_{N_1}=P_{N2}$ may be used. For example $A^2P_{N_1}=P_{N2}$ Estimating $P_S$, A, and $P_N$ Given the subband representation of the stereo signal, the power ($P_{X_1}$, $P_{X_2}$) and the normalized cross-correlation are computed. The normalized cross-correlation between left and right is:

$$\Phi(i,k)=\frac{E\{X_1(i,k)X_2(i,k)\}}{\sqrt{E\{X_1^2(i,k)\}E\{X_2^2(i,k)\}}} \tag{3}$$

A, $P_S$, and $P_N$ are computed as a function of the estimated $Px_1$, $Px_2$ and $\Phi$. Three equations relating the known and unknown variables are:

$$Px_1=P_S+P_N \tag{4}$$
$$Px_2=A^2P_S+P_N$$

-continued $$\Phi=\frac{aS}{\sqrt{Px_1\,Px_2}}$$

These equations solved for A, $P_S$, and $P_N$, yield $$A=\frac{B}{2C} \tag{5}$$
$$P_S=\frac{2C^2}{B}$$
$$P_N=X_1-\frac{2C^2}{B}$$

with $$B=Px_2-Px_1+\sqrt{(Px_1-Px_2)^2+4Px_1Px_2\Phi^2} \tag{6}$$
$$C=\Phi\sqrt{Px_1Px_2}$$

Least Squares Estimation of S, $N_1$ and $N_2$

Next, the least squares estimates of S, $N_1$ and $N_2$ are computed as a function of A, $P_S$, and $P_N$. For each i and k, the signal S is estimated as $$\hat{S}=\omega_1X_1+\omega_2X_2=\omega_1(S+N_1)+\omega_2(AS+N_2) \tag{7}$$

where $\omega_1$ and $\omega_2$ are real-valued weights. The estimation error is $$E=(1-\omega_1-\omega_2A)S-\omega_1N_1-\omega_2N_2 \tag{8}$$

The weights $\omega_1$ and $\omega_2$ are optimal in a least mean square sense when the error E is orthogonal to $X_1$ and $X_2$, i.e.

$$E\{EX_1\}=0E\{EX_2\}=0 \tag{9}$$

yielding two equations, $$(1-\omega_1-\omega_2A)P_s-\omega_1P_N=0,$$

$$A(1-\omega_1-\omega_2A)P_s-\omega_2P_N=0 \tag{10}$$

from which the weights are computed, $$\omega_1=\frac{P_SP_N}{(A^2+1)P_SP_N+P_N^2} \tag{11}$$
$$\omega_2=\frac{AP_SP_N}{(A^2+1)P_SP_N+P_N^2}$$

Similarly, $N_1$ and $N_2$, are estimated. The estimate of $N_1$ is $$\hat{N}_1=\omega_3X_1+\omega_4X_2=\omega_3(S+N_1)+\omega_4(AS+N_2) \tag{12}$$

The estimation error is $$E=(\omega_3-\omega_4A)S-(1-\omega_3)N_1-\omega_2N2 \tag{13}$$

Again, the weights are computed such that the estimation error is orthogonal to $X_1$ and $X_2$ resulting in $$\omega_3=\frac{A^2P_SP_N+P_N^2}{(A^2+1)P_SP_N+P_N^2} \tag{14}$$
$$\omega_4=\frac{-AP_SP_N}{(A^2+1)P_SP_N+P_N^2}$$

The weights for computing the least squares estimate of $N_2$ are $$\hat{N}_2 = \omega_5 X_1 + \omega_6 X_2 = \omega_5(S + N_1) + \omega_6(AS + N_2) \tag{15}$$

are $$\omega_5 = \frac{-AP_S P_N}{(A^2+1)P_S P_N + P_N^2} \tag{16}$$

$$\omega_6 = \frac{P_S P_N + P_N^2}{(A^2+1)P_S P_N + P_N^2}$$

Post-Scaling

Given the least squares estimates, these are (optionally) post-scaled such that the power of the estimates $\hat{S}$, $\hat{N}_1$, $\hat{N}_2$ equals to $P_S$ and $P_N=P_{N1}=P_{N2}$. The power of $\hat{S}$ is $$P_{\hat{S}}=(\omega_1+a\omega_2)^2P_s+(\omega_1^2+\omega_2^2)P_N \tag{17}$$

Thus, for obtaining an estimate of S with power $P_S$, $\hat{S}$ is scaled $$\hat{S}' = \frac{\sqrt{P_N}}{\sqrt{(\omega_1 + a\omega_2)^2 P_S + (\omega_1^2 + \omega_2^2)P_N}}\hat{S} \tag{18}$$

With similar reasoning, $\hat{N}_1$ and $\hat{N}_2$ are scaled, i.e.

$$\hat{N}_1' = \frac{\sqrt{P_N}}{\sqrt{(\omega_3 + a\omega_4)^2 P_S + (\omega_3^2 + \omega_4^2)P_N}}\hat{N}_1 \tag{19}$$

$$\hat{N}_2' = \frac{\sqrt{P_N}}{\sqrt{(\omega_5 + a\omega_6)^2 P_S + (\omega_5^2 + \omega_6^2)P_N}}\hat{N}_2$$

NUMERICAL EXAMPLES

Figure 6:
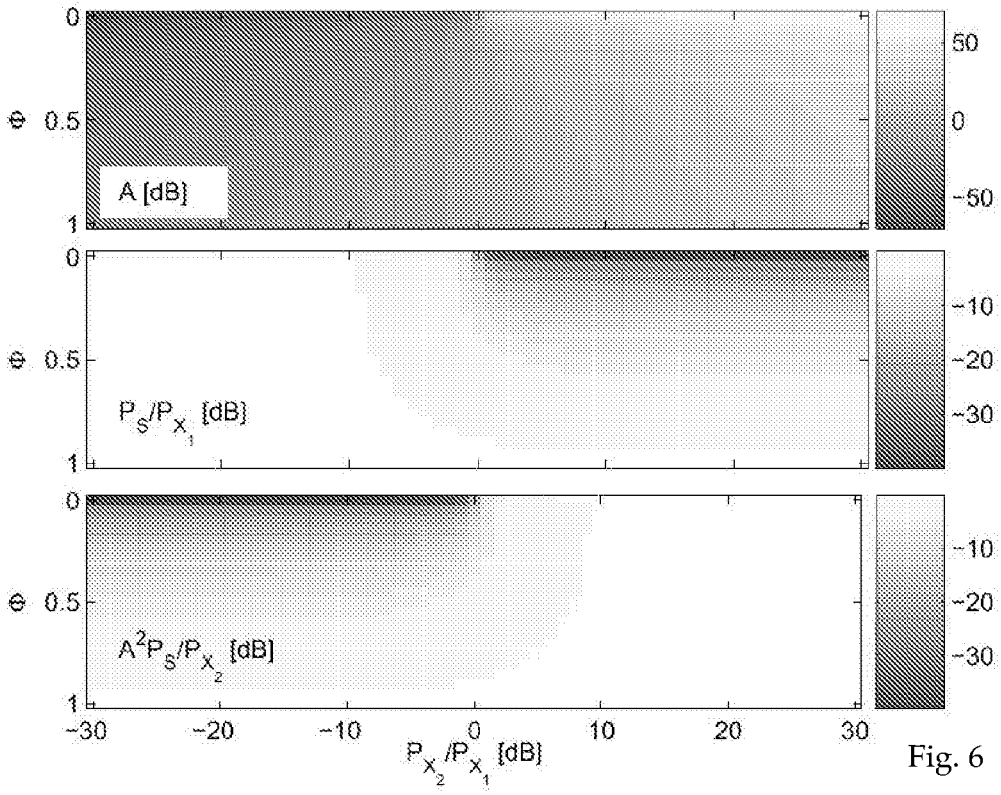
FIG. 6 shows the direction direction factor A and the normalized power of S and AS, FIG. 7 shows the least squares estimate weights $w_1$ and $w_2$ and the post scaling factor for the computation of the estimate of s.

The direction factor A and the normalized power of S and AS are shown as a function of the stereo signal level difference and Φ in FIG. 6.

Figure 7:
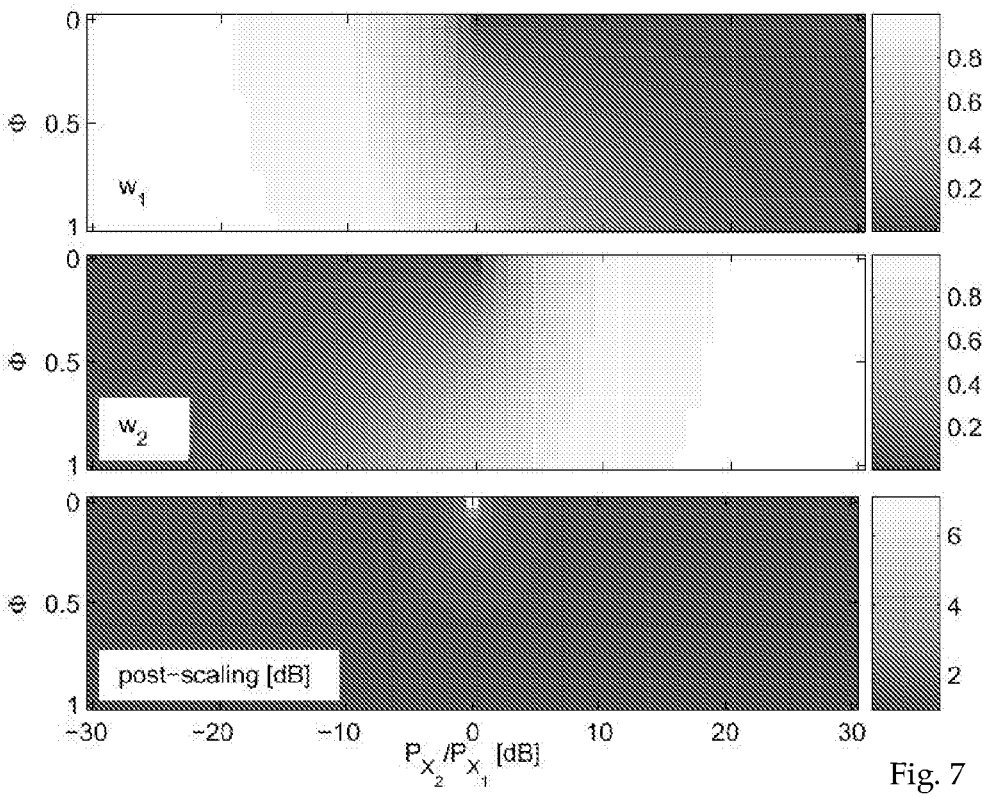
Figure 8:
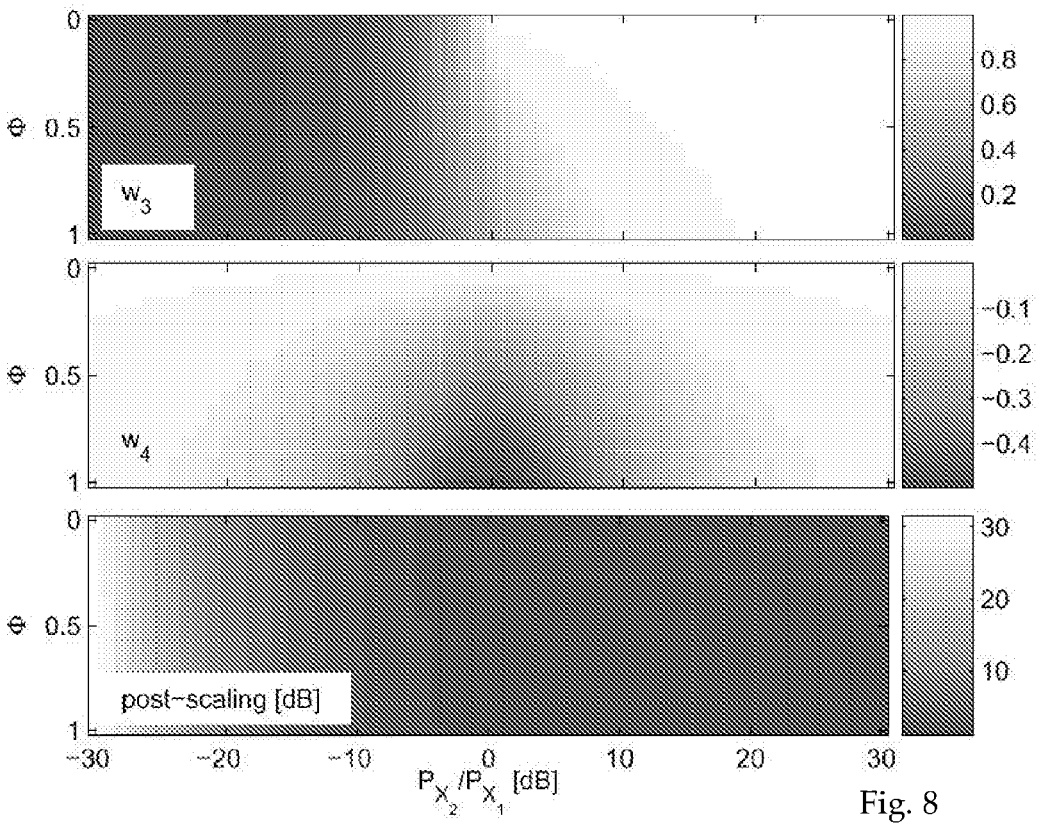
FIG. 8 shows the least squares estimate weights $w_3$ and $w_4$ and the post scaling factor for the computation of the estimate of $N_1$.
Figure 9:
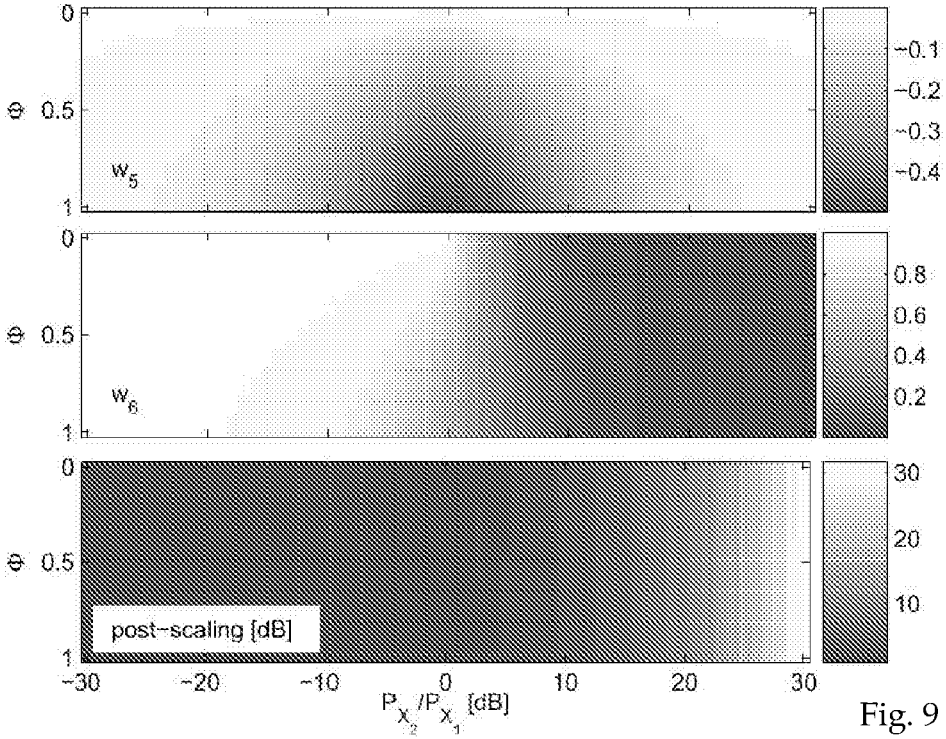
FIG. 9 shows the least squares estimate weights $w_5$ and $w_6$ and the post scaling factor for the computation of the estimate of $N_2$.

The weights $\omega_1$ and $\omega_2$ for computing the least squares estimate of S are shown in the top two panels of FIG. 7 as a function of the stereo signal level difference and Φ. The post-scaling factor for $\hat{S}$ (18) is shown in the bottom panel.

The weights $\omega_3$ and $\omega_2$ for computing the least squares estimate of $N_1$ and the corresponding post-scaling factor (19) are shown in FIG. 7 as a function of the stereo signal level difference and Φ.

The weights $\omega_5$ and $\omega_6$ for computing the least squares estimate of $N_2$ and the corresponding post-scaling factor (19) are shown in FIG. 7 as a function of the stereo signal level difference and Φ.

Figure 10:
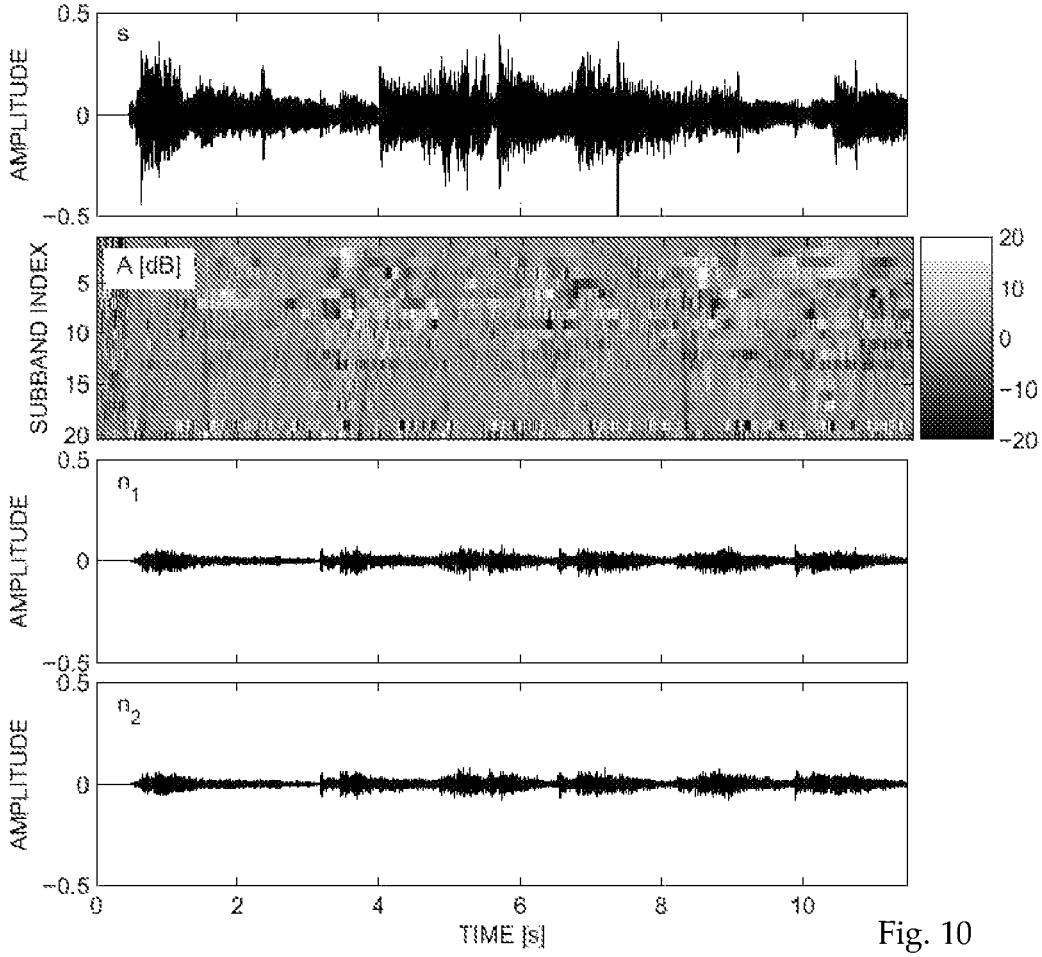
FIG. 10 shows the estimated s, A, $n_1$ and $n_2$.

An example for the spatial decomposition of a stereo rock music clips with a singer in the center is shown in FIG. 10. The estimates of s, A, $n_1$ and $n_2$ are shown. The signals are shown in the time-domain and A is shown for every time-frequency tile. The estimated direct sound s is relatively strong compared to the independent lateral sound $n_1$ and $n_2$ since the singer in the center is dominant.

Playing Back the Decomposed Stereo Signals Over Different Playback Setups

Given the spatial decomposition of the stereo signal, i.e. the subband signals for the estimated localized direct sound $\hat{S}'$, the direction factor A, and the lateral independent sound $\hat{N}_1'$ and $\hat{N}_2'$, one can define rules on how to emit the signal components corresponding to $\hat{S}'$, $\hat{N}_1'$ and $\hat{N}_2'$, from different playback setups.

Multiple Loudspeakers in Front of the Listener

Figure 11:
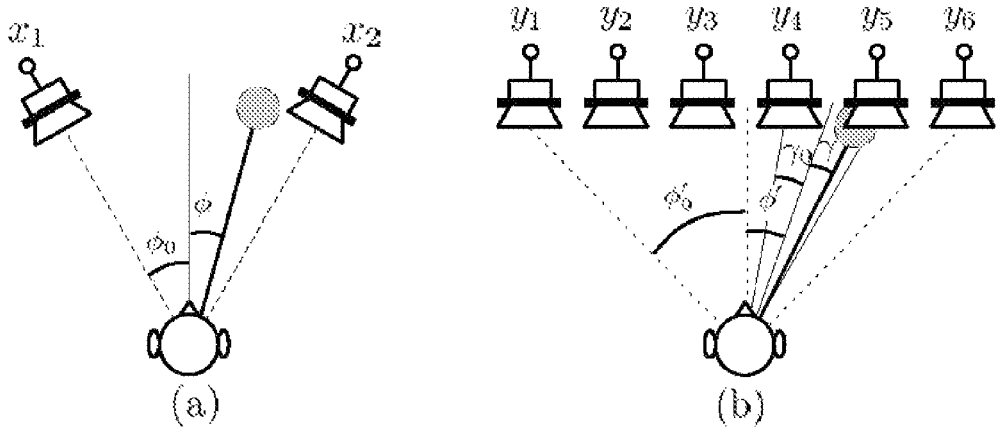
FIG. 11 shows the ±30° virtual sound stage (a) converted to a virtual sound stage with the width of the aperture of a loudspeaker array (b)

FIG. 11 illustrates the scenario that is addressed. The virtual sound stage of width $\Phi_0$=30°, shown in Part (a) of the figure, is scaled to a virtual sound stage of width $\Phi_0'$ which is reproduced with multiple loudspeakers, shown in Part (b) of the figure.

The estimated independent lateral sound, $\hat{N}'_1$ and $\hat{N}'_2$, is emitted from the loudspeakers on the sides, e.g. loudspeakers 1 and 6 in FIG. 11(*b*). That is, because the more the lateral sound is emitted from the side the more it is effective in terms enveloping the listener into the sound. Given the estimated direction factor A, the angle Φ of the auditory event relative to the $\pm\Phi_0$ virtual sound stage is estimated, using the "stereophonic law of sines" (or other laws relating A to the perceived angle), $$\phi = \sin^{-1}\left(\frac{A-1}{A+1}\sin\phi_0\right) \tag{20}$$

This angle is linearly scaled to compute the angle relative to the widened sound stage, $$\phi' = \frac{\phi_0'}{\phi_0}\phi \tag{21}$$

The loudspeaker pair enclosing Φ' is selected. In the example illustrated in FIG. 11(*b*) this pair has indices 4 and 5. The angles relevant for amplitude panning between this loudspeaker pair, $\gamma_0$ and $\gamma_1$, are defined as shown in the figure. If the selected loudspeaker pair has indices l and l+1 then the signals given to these loudspeakers are $$a_1\sqrt{1+A^2S}$$

$$a_2\sqrt{1+A^2S} \tag{22}$$

where the amplitude panning factors $a_1$ and $a_2$ are computed with the stereophonic law of sines (or another amplitude panning law) and normalized such that $a_1^2+a_2^2=1$, $$a_1 = \frac{1}{\sqrt{1+C^2}} \tag{23}$$

$$a_2 = \frac{C}{\sqrt{1+C^2}}$$

with $$C = \frac{\sin(\gamma_0+\gamma)}{\sin(\gamma_0-\gamma)} \tag{24}$$

The factors in $\sqrt{1+A^2}$ in (22) are such that the total power of these signals is equal to the total power of the coherent components, S and AS, in the stereo signal. Alternatively, one can use amplitude panning laws which give signal to more than two loudspeakers simultaneously.

Figure 12:
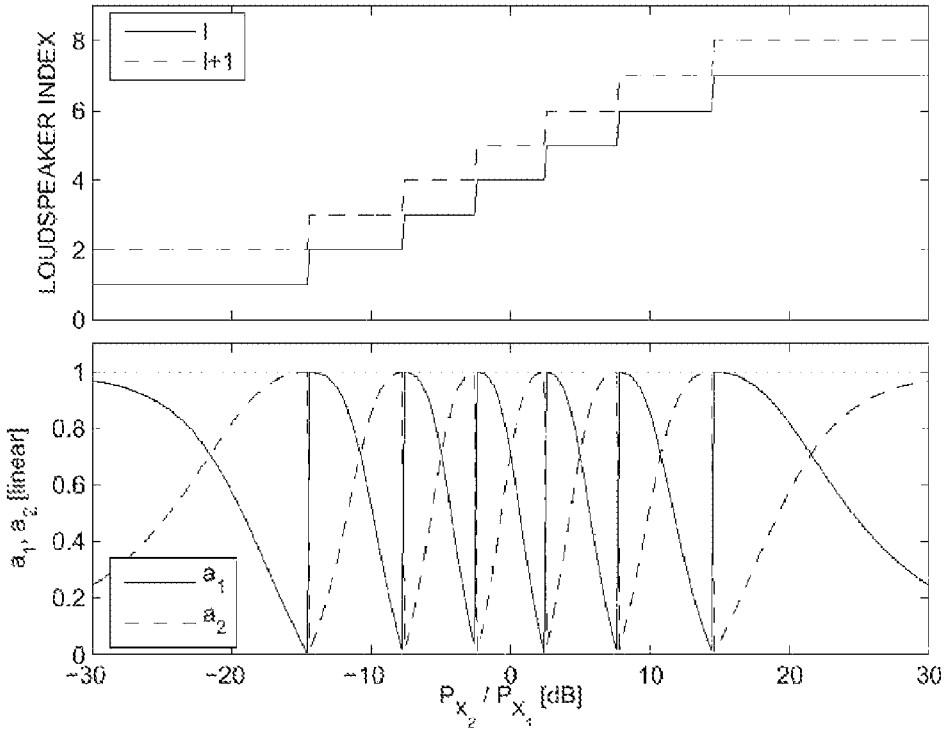
FIG. 12 shows loudspeaker pair selection l and factors $a_1$ and $a_2$ as a function of the stereo signal level difference.

FIG. 12 shows an example for the selection of loudspeaker pairs, l and l+1, and the amplitude panning factors $a_1$ and $a_2$ for $\Phi'_0=\Phi_0=30°$ for M=8 loudspeakers at angles {−30°, −20°, −12°, −4°, 4°, 12°, 20°, 30°}.

Given the above reasoning, each time-frequency tile of the output signal channels, i and k, is computed as $$Y_m = \delta(m-1)\hat{N}_1' + \delta(m-M)\hat{N}_2' + (\delta(m-l)a_1 + \delta(m-l-1)a_2)\sqrt{1+A^2}\,\hat{S}' \tag{25}$$

where $$\delta(m) = \begin{cases} 1 & \text{for } m = 0 \\ 0 & \text{otherwise} \end{cases} \tag{26}$$

and m is the output channel index $1 \leqq m \leqq M$. The subband signals of the output channels are converted back to the time domain and form the output channels $y_1$ to $y_M$. In the following, this last step is not always again explicitly mentioned.

Figure 13:
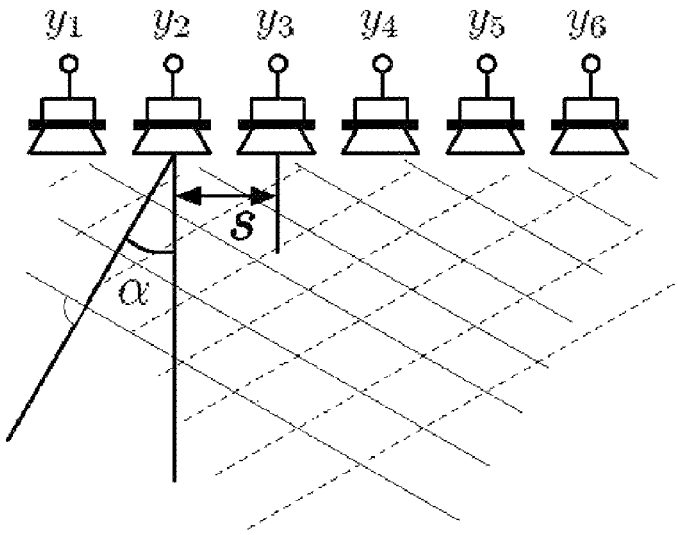
FIG. 13 shows an emission of plane waves through a plurality of loudspeakers.

A limitation of the described scheme is that when the listener is at one side, e.g. close to loudspeaker 1, the lateral independent sound will reach him with much more intensity than the lateral sound from the other side. This problem can be circumvented by emitting the lateral independent sound from all loudspeakers with the aim of generating two lateral plane waves. This is illustrated in FIG. 13. The lateral independent sound is given to all loudspeakers with delays mimicking a plane wave with a certain direction, $$Y_m(i,k) = \frac{\hat{N}_1'(i,k-(m-1)d)}{\sqrt{M}} + \frac{\hat{N}_2'(i,k-(M-m)d)}{\sqrt{M}} + (\delta(m-l)a_1 + \delta(m-l-1)a_2)\sqrt{1+A^2}\,\hat{S}' \tag{27}$$

where d is the delay, $$d = \frac{s f_s \sin\alpha}{v} \tag{28}$$

s is the distance between the equally spaced loudspeakers, v is the speed of sound, $f_s$ is the subband sampling frequency, and $\pm\alpha$ are the directions of propagation of the two plane waves. In our system, the subband sampling frequency is not high enough such that d can be expressed as an integer. Thus, we are first converting $\hat{N}'_1$ and $\hat{N}'_2$ to the time-domain and then we add its various delayed versions to the output channels.

Multiple Front Loudspeakers Plus Side Loudspeakers

The previously described playback scenario aims at widening the virtual sound stage and at making the perceived sound stage independent of the location of the listener.

Figure 14:
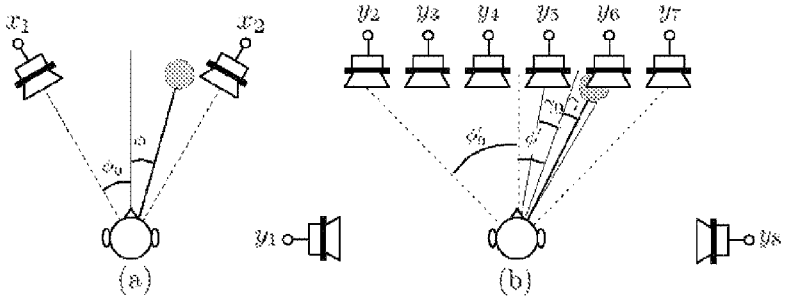
FIG. 14 shows the ±30° virtual sound stage (a) converted to a virtual sound stage with the width of the aperture of a loudspeaker array with increased listener envelopment by emitting independent sound from the side loudspeakers (b)

Optionally one can play back the independent lateral sound, $\hat{N}'_1$ and $\hat{N}'_2$ with separate two loudspeakers located more to the sides of the listener, as illustrated in FIG. 14. The ±30° virtual sound stage (a) is converted to a virtual sound stage with the width of the aperture of a loudspeaker array (b). Additionally, the lateral independent sound is played from the sides with separate loudspeakers for a stronger listener envelopment. It is expected that this results in a stronger impression of listener envelopment. In this case, the output signals are also computed by (25), where the signals with index 1 and M are the loudspeakers on the side. The loudspeaker pair selection, l and l+1, is in this case such that $\hat{S}'$ is never given to the signals with index 1 and M since the whole width of the virtual stage is projected to only the front loudspeakers $2 \leqq m \leqq M-1$.

Figure 15:
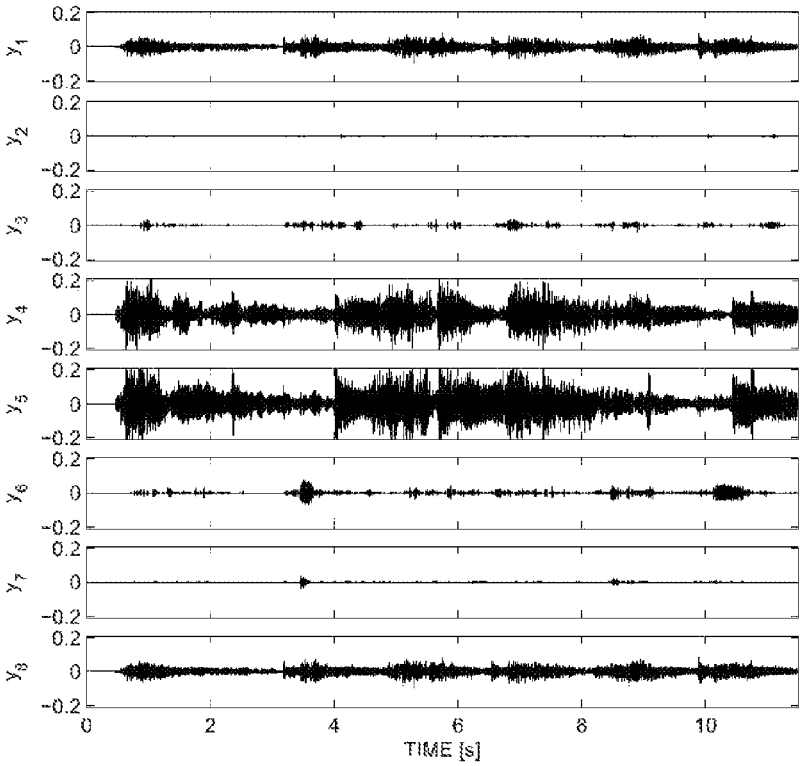
FIG. 15 shows the eight signals, generated for a setup as in FIG. 14(*b*)

FIG. 15 shows an example for the eight signals generated for the setup shown in FIG. 14 for the same music clip for which the spatial decomposition was shown in FIG. 10. Note that the dominant singer in the center is amplitude panned between the center two loudspeaker signals, $y_4$ and $y_5$.

Conventional 5.1 Surround Loudspeaker Setup

One possibility to convert a stereo signal to a 5.1 surround compatible multi-channel audio signal is to use a setup as shown in FIG. 14(*b*) with three front loudspeakers and two rear loudspeakers arranged as specified in the 5.1 standard. In this case, the rear loudspeakers emit the independent lateral sound, while the front loudspeakers are used to reproduce the virtual sound stage. Informal listening indicates that when playing back audio signals as described listener envelopment is more pronounced compared to stereo playback.

Another possibility to convert a stereo signal to a 5.1 surround compatible signal is to use a setup as shown in FIG. 11 where the loudspeakers are rearranged to match a 5.1 configuration. In this case, the ±30° virtual stage is extended to a ±110° virtual stage surrounding the listener.

Wavefield Synthesis Playback System

Figure 16:
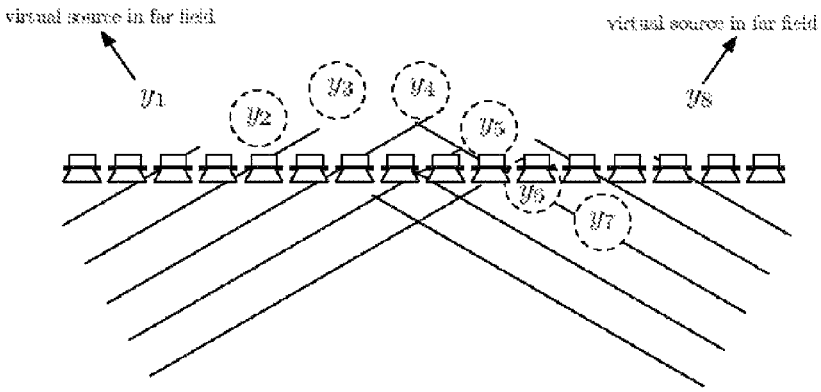
FIG. 16 shows each signal corresponding to the front sound stage defined as a virtual source. The independent lateral sound is emitted as plane waves (virtual sources in the far field)

First, signals $y_1, y_2, \ldots y_M$ are generated similar as for a setup as is illustrated in FIG. 14(*b*). Then, for each signal, $y_1, y_2, \ldots y_M$, a virtual source is defined in the wavefield synthesis system. The lateral independent sound, $y_1$ and $y_M$, is emitted as plane waves or sources in the far field as is illustrated in FIG. 16 for M=8. For each other signal, a virtual source is defined with a location as desired. In the example shown in FIG. 16, the distance is varied for the different sources and some of the sources are defined to be in the front of the sound emitting array, i.e. the virtual sound stage can be defined with an individual distance for each defined direction.

Generalized Scheme for 2-to-M Conversion

Generally speaking, the loudspeaker signals for any of the described schemes can be formulated as:

$$Y = MN \tag{29}$$

where N is a vector containing the signals $\hat{N}'_1$, $\hat{N}'_2$, and $\hat{S}'$. The vector Y contains all the loudspeaker signals. The matrix M has elements such that the loudspeaker signals in vector Y will be the same as computed by (25) or (27). Alternatively, different matrices M may be implemented using filtering and/or different amplitude panning laws (e.g. panning of $\hat{S}'$ using more than two loudspeakers). For wavefield synthesis systems, the vector Y may contain all loudspeaker signals of the system (usually >M). In this case, the matrix M also contains delays, all-pass filters, and filters in general to implement emission of the wavefield corresponding to the virtual sources associated to $\hat{N}'_1$, $\hat{N}_2$ and $\hat{S}'$. In the claims, a relation like (29) having delays, all-pass filters, and/or filters in general as matrix elements of M is denoted a linear combination of the elements in N.

Modifying the Decomposed Audio Signals

Controlling the Width of the Sound Stage

By modifying the estimated direction factors, e.g. A(i,k), one can control the width of the virtual sound stage. By linear scaling of the direction factors with a factor larger than one, the instruments being part of the sound stage are moved more to the side. The opposite can be achieved by scaling with a factor smaller than one. Alternatively, one can modify the amplitude panning law (20) for computing the angle of the localized direct sound.

Modifying the Ratio Between Localized Direct Sound and the Independent Sound

For controlling the amount of ambience one can scale the independent lateral sound signals $\hat{N}'_1$ and $\hat{N}'_2$ for getting more or less ambience. Similarly, the localized direct sound can be modified in strength by means of scaling the S' signals.

Modifying Stereo Signals

One can also use the proposed decomposition for modifying stereo signals without increasing the number of channels. The aim here is solely to modify either the width of the virtual sound stage or the ratio between localized direct sound and the independent sound. The subbands for the stereo output are in this case $$Y_1=v_1\hat{N}'_1+v_2\hat{S}'Y_2=v_1\hat{N}'_2+v_2v_3A\hat{S}' \tag{30}$$

where the factors $v_1$ and $v_2$ are used to control the ratio between independent sound and localized sound. For $v_3\neq 1$ also the width of the sound stage is modified (whereas in this case $v_2$ is modified to compensate the level change in the localized sound for $v_3\neq 1$).

Generalization to More than Two Input Channels

Formulated in words, the generation of $\hat{N}'_1$, $\hat{N}'_2$ and $\hat{S}'$ for the two-input-channel case is as follows (this was the aim of the least squares estimation). The lateral independent sound $\hat{N}'_1$ is computed by removing from $X_1$ the signal component that is also contained in $X_2$. Similarly, $\hat{N}'_2$ is computed by removing from $X_1$ the signal component that is also contained in $X_1$. The localized direct sound $\hat{S}'$ is computed such that it contains the signal component present in both, $X_1$ and $X_2$, and A is the computed magnitude ratio with which S' is contained in $X_1$ and $X_2$. A represents the direction of the localized direct sound.

Figure 17:
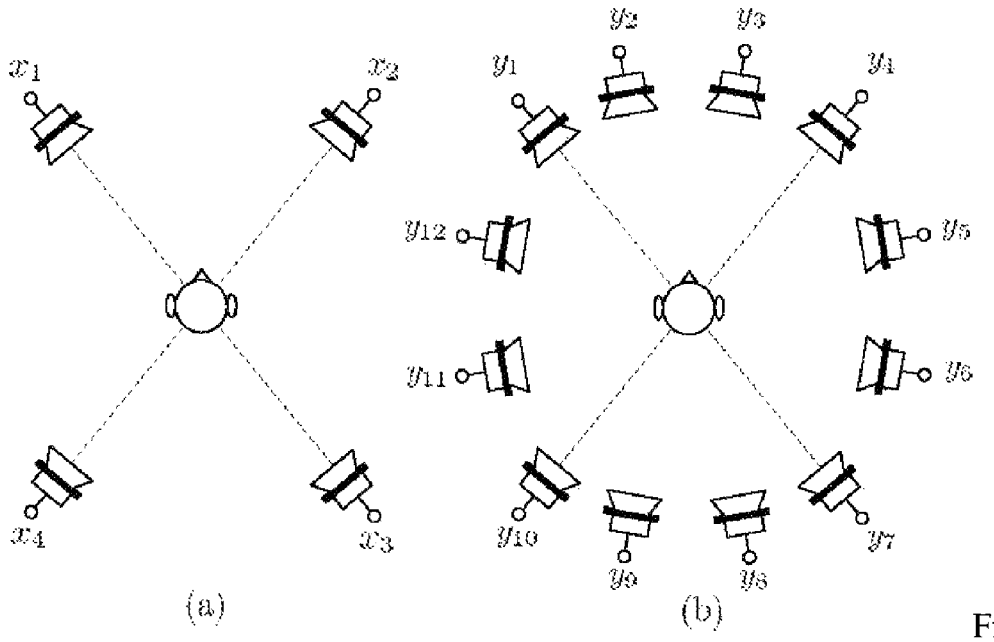
FIG. 17 shows a quadraphonic sound system (a) extended for use with more loudspeakers (b).

As an example, now a scheme with four input channels is described. Suppose a quadraphonic system with loudspeaker signals $x_1$ to $x_4$, as illustrated in FIG. 17(*a*), is supposed to be extended with more playback channels, as illustrated in FIG. 17(*b*). Similar as in the two-input-channel case, independent sound channels are computed. In this case these are four (or if desired less) signals $\hat{N}'_1$, $\hat{N}'_2$, $\hat{N}'_3$, and $\hat{N}'_4$. These signals are computed in the same spirit as described above for the two-input-channel case. That is, the independent sound $\hat{N}'_1$ is computed by removing from $X_1$ the signal components that are either also contained in $X_2$ or $X_4$ (the signals of the adjacent quadraphony loudspeakers). Similarly, $\hat{N}'_2$, $\hat{N}'_3$, and $\hat{N}'_4$ are computed. Localized direct sound is computed for each channel pair of adjacent loudspeakers, i.e. $\hat{S}'_{12}$, $\hat{S}'_{23}$, $\hat{S}'_{34}$, and $\hat{S}'_{41}$. The localized direct sound $\hat{S}'_{12}$ is computed such that it contains the signal component present in both, $X_1$ and $X_2$, and $A_{12}$ is the computed magnitude ratio with which $\hat{S}'_{12}$ is contained in $X_1$ and $X_2$. $A_{12}$ represents the direction of the localized direct sound. With similar reasoning, $\hat{S}'_{23}$, $\hat{S}'_{34}$, $\hat{S}'_{41}$, $A_{23}$, $A_{34}$ and $A_{41}$ are computed. For playback over the system with twelve channels, shown in FIG. 17(*b*), $\hat{N}'_1$, $\hat{N}'_2$, $\hat{N}'_3$, and $\hat{N}'_4$ are emitted from the loudspeakers with signals $y_1$, $y_4$, $y_7$ and $y_{12}$. To the front loudspeakers, $y_1$ to $y_4$, a similar algorithm is applied as for the two-input-channel case for emitting $\hat{S}'_{12}$, i.e. amplitude panning of $\hat{S}'_{12}$ over the loudspeaker pair most close to the direction defined by $A_{12}$. Similarly, $\hat{S}'_{23}$, $\hat{S}'_{34}$, $\hat{S}'_{41}$, are emitted from the loudspeaker arrays directed to the three other sides as a function of $A_{23}$, $A_{34}$ and $A_{41}$. Alternatively, as in the two-input-channel case, the independent sound channels may be emitted as plane waves. Also playback over wavefield synthesis systems with loudspeaker arrays around the listener is possible by defining for each loudspeaker in FIG. 17(*b*) a virtual source, similar in spirit of using wavefield synthesis for the two-input-channel case. Again, this scheme can be generalized, similar to (29), where in this case the vector N contains the subband signals of all computed independent and localized sound channels.

With similar reasoning, a 5.1 multi-channel surround audio system can be extended for playback with more than five main loudspeakers. However, the center channel needs special care, since often content is produced where amplitude panning between left front and right front is applied (without center). Sometimes amplitude panning is also applied between front left and center, and front right and center, or simultaneously between all three channels. This is different compared to the previously described quadraphony example, where we have used a signal model assuming that there are common signal components only between adjacent loudspeaker pairs. Either one takes this into consideration to compute the localized direct sound accordingly, or, a simpler solution is to downmix the front three channels to two channels and applying afterward the system described for quadraphony.

A simpler solution for extending the scheme with two input channels for more input channels, is to apply the scheme for two input channels heuristically between certain channels pairs and then combining the resulting decompositions to compute, in the quadraphonic case for example, $\hat{N}'_1$, $\hat{N}'_2$, $\hat{N}'_3$, $\hat{N}_4$, $\hat{S}'_{12}$, $\hat{S}'_{23}$, $\hat{S}'_{34}$, $\hat{S}'_{41}$, $A_{12}$, $A_{23}$, $A_{34}$ and $A_{41}$. Playback of these is done as described for the quadraphonic case.

Computation of Loudspeaker Signals for Ambisonics

The Ambisonic system is a surround audio system featuring signals which are independent of the specific playback setup. A first order Ambisonic system features the following signals which are defined relative to a specific point P in space:

$$W=S$$

$$X=S\cos\Psi\cos\Phi$$

$$Y=S\sin\Psi\cos\Phi$$

$$Z=S\sin\Phi$$

where W=S is the (omnidirectional) sound pressure signal in P. The signals X, Y and Z are the signals obtained from dipoles in P, i.e. these signals are proportional to the particle velocity in Cartesian coordinate directions x, y and z (where the origin is in point P). The angles Ψ and Φ denote the azimuth and elevation angles, respectively (spherical polar coordinates). The so-called "B-Format" signal additionally features a factor of $\sqrt{2}$ for W X, Y and Z.

To generate M signals, for playback over an M-channel three dimensional loudspeaker system, signals are computed representing sound arriving from the eight directions x, −x, y, −y, z, −z. This is done by combining W X, Y and Z to get directional (e.g. cardioid) responses, e.g.

$$x_1=W+X\ x_3=W+Y\ x_5=W+Z$$

$$x_2=W-X\ x_4=W-Y\ x_6=W-Z \tag{31}$$

Given these signals, similar reasoning as described for the quadraphonic system above is used to compute eight independent sound subband signals (or less if desired) $\hat{N}'_c$ ($1\leqq c\leqq 8$). For example, the independent sound $\hat{N}'_1$ is computed by removing from $X_1$ the signal components that are either also contained in the spatially adjacent channels $X_3$, $X_4$, $X_5$ or $X_6$. Additionally, between adjacent pairs or triples of the input signals localized direct sound and direction factors representing its direction are computed. Given this decomposition, the sound is emitted over the loudspeakers, similarly as described in the previous example of quadraphony, or in general (29).

For a two dimensional Ambisonics system, $$W=S$$

$$X=S\cos\Psi$$

$$Y=S\sin\Psi \tag{33}$$

resulting in four input signals, $x_1$ to $x_4$, the processing is similar to the described quadraphonic system.

Decoding of Matrixed Surround

A matrix surround encoder mixes a multi-channel audio signal (for example 5.1 surround signal) down to a stereo signal. This format of representing multi-channel audio signals is denoted "matrixed surround". For example, the channels of a 5.1 surround signals may be downmixed by a matrix encoder in the following way (for simplicity we are ignoring the low frequency effects channel):

$$x_1(n) = l(n) + \frac{1}{\sqrt{2}}c(n) + j\frac{1}{\sqrt{2}}l_s(n) + j\frac{1}{\sqrt{6}}r_s(n)$$

$$x_2(n) = r(n) + \frac{1}{\sqrt{2}}c(n) - j\frac{1}{\sqrt{2}}r_s(n) - j\frac{1}{\sqrt{6}}l_s(n)$$

where l, r, c, $l_s$, and $r_s$ denote the front left, front right, center, rear left, and rear right channels respectively. The j denotes a 90 degree phase shift, and −j is a −90 degree phase shift. Other matrix encoders may use variations of the described downmix.

Similar as previously described for the 2-to-M channel conversion, one may apply the spatial decomposition to the matrix surround downmix signal. Thus for each subband at each time independent sound subbands, localized sound subbands, and direction factors are computed. Linear combinations of the independent sound subbands and localized sound subbands are emitted from each loudspeaker of the surround system that is to emit the matrix decoded surround signal.

Note that the normalized correlation is likely to also take negative values, due to the out-of-phase components in the matrixed surround downmix signal. If this is the case, the corresponding direction factors will be negative, indicating that the sound originated from a rear channel in the original multi-channel audio signal (before matrix downmix).

This way of decoding matrixed surround is very appealing, since it has low complexity and at the same time a rich ambience is reproduced by the estimated independent sound subbands. There is no need for generating artificial ambience, which is very computationally complex.

Implementation Details

For computing the subband signals, a Discrete (Fast) Fourier Transform (DFT) can be used. For reducing the number of bands, motivated by complexity reduction and better audio quality, the DFT bands can be combined such that each combined band has a frequency resolution motivated by the frequency resolution of the human auditory system. The described processing is then carried out for each combined subband. Alternatively, Quadrature Mirror Filter (QMF) banks or any other non-cascaded or cascaded filterbanks can be used.

Two critical signal types are transients and stationary/tonal signals. For effectively addressing both, a filterbank may be used with an adaptive time-frequency resolution. Transients would be detected and the time resolution of the filterbank (or alternatively only of the processing) would be increased to effectively process the transients. Stationary/tonal signal components would also be detected and the time resolution of the filterbank and/or processing would be decreased for these types of signals. As a criterion for detecting stationary/tonal signal components one may use a "tonality measure".

Our implementation of the algorithm uses a Fast Fourier Transform (FFT). For 44.1 kHz sampling rate we use FFT sizes between 256 and 1024. Our combined subbands have a bandwidth which is approximately two times the critical bandwidth of the human auditory system. This results in using about 20 combined subbands for 44.1 kHz sampling rate.

Application Examples

Television Sets

For playing back the audio of stereo-based audiovisual TV content, a center channel can be generated for getting the benefit of a "stabilized center" (e.g. movie dialog appears in the center of the screen for listeners at all locations). Alternatively, stereo audio can be converted to 5.1 surround if desired.

Stereo to Multi-Channel Conversion Box

A conversion device would convert audio content to a format suitable for playback over more than two loudspeakers. For example, this box could be used with a stereo music player and connect to a 5.1 loudspeaker set. The user could have various options: stereo+center channel, 5.1 surround with front virtual stage and ambience, 5.1 surround with a ±110° virtual sound stage surrounding the listener, or all loudspeakers arranged in the front for a better/wider front virtual stage.

Such a conversion box could feature a stereo analog line-in audio input and/or a digital SP-DIF audio input. The output would either be multi-channel line-out or alternatively digital audio out, e.g. SP-DIF.

Devices and Appliances with Advanced Playback Capabilities

Such devices and appliances would support advanced playback in terms of playing back stereo or multi-channel surround audio content with more loudspeakers than conventionally. Also, they could support conversion of stereo content to multi-channel surround content.

Multi-Channel Loudspeaker Sets

A multi-channel loudspeaker set is envisioned with the capability of converting its audio input signal to a signal for each loudspeaker it features.

Automotive Audio

Automotive audio is a challenging topic. Due to the listeners' positions and due to the obstacles (seats, bodies of various listeners) and limitations for loudspeaker placement it is difficult to play back stereo or multi-channel audio signals such that they reproduce a good virtual sound stage. The proposed algorithm can be used for computing signals for loudspeakers placed at specific positions such that the virtual sound stage is improved for the listener that are not in the sweet spot.

Additional Field of Use

A perceptually motivated spatial decomposition for stereo and multi-channel audio signals was described. In a number of subbands and as a function of time, lateral independent sound and localized sound and its specific angle (or level difference) are estimated. Given an assumed signal model, the least squares estimates of these signals are computed.

Furthermore, it was described how the decomposed stereo signals can be played back over multiple loudspeakers, loudspeaker arrays, and wavefield synthesis systems. Also it was described how the proposed spatial decomposition is applied for "decoding" the Ambisonics signal format for multi-channel loudspeaker playback. Also it was outlined how the described principles are applied for microphone signals, ambisonics B-format signals, and matrixed surround signals.

The invention claimed is:

1. Method to generate multiple output audio channels (y1, . . . , yM) from multiple input audio channels (x1, . . . , xL), in which the number of output channels is equal or higher than the number of input channels, this method comprising the steps of:

by means of linear combinations of input subbands X1(i), . . . , XL(i), computing one or more independent sound subbands representing signal components, by removing from an input subband signal components which are also present in one or more of the other input subbands, the independent sound subbands representing signal components which are independent between the input subbands, by means of linear combinations of the input subbands X1(i), . . . , XL(i), computing one or more localized direct sound subbands representing signal components which are contained in more than one of the input subbands, and computing corresponding direction factors representing the ratios of the localized direct sound subbands representing signal components contained in two or more input subbands, generating the output subbands, Y1(i) . . . YM(i), comprising the steps of:

for each independent sound subband, selecting a subset of the output subbands, and scaling the corresponding independent sound subband, for each direction factor, selecting the subset of output subbands, and scaling the corresponding localized direct sound subband, and adding the scaled corresponding independent sound subband to the scaled corresponding localized direct sound subband, and converting the output subbands, Y1(i) . . . YM(i), to time domain audio signals, y1 . . . yM.

2. The method of claim 1, in which on at least one selected pair of input subbands, the localized direct sound subband S(i) is computed according to the signal component contained in the input subbands belonging to the corresponding pair, and the direction factors A(i) is computed to be the ratio at which the direct sound subbands S(i) is contained in the input subbands belonging to the corresponding pair.

3. The method of claim 1 in which the computation of the independent sound subbands N(i), the localized direct sound subbands S(i), and the direction factors A(i) are computed as a function of the input subbands $X_1(i) \ldots X_L(i)$, the input subband power, and normalized cross-correlation between input subband pairs.

4. The method of claim 1 in which the computation of the independent sound subbands N(i) and the localized direct sound subbands S(i) are linear combinations of the input subbands $X_1(i) \ldots X_L(i)$, where the weights of the linear combination are determined with the help of a least mean square criterion.

5. The method of claim 4 in which the subband power of the estimated independent sound subbands N(i) and the localized direct sound subbands S(i) are is adjusted such that their subband power is equal to the corresponding subband power computed as a function of input subband power, and normalized cross-correlation between input subband pairs.

6. The method of claim 1, in which the input channels $x_1 \ldots x_L$ are only a subset of the channels of a multi-channel audio signal $x_1 \ldots x_D$, where the output channels $y_1 \ldots y_M$ are complemented with the non-processed input channels.

7. The method of claim 1 in which the input channels $x_1 \ldots x_L$ and output channels $y_1 \ldots y_M$ correspond to signals for loudspeakers located at specific directions relative to a specific listening position, and the generation of the output signal subbands is as follows:

the linear combination of the independent sound subbands N(i) and the localized direct sound subbands S(i) is such that the output subbands $Y_1(i) \ldots Y_M(i)$ are generated according to:

the independent sound subbands N(i) are mixed into the output subbands such that the corresponding sound is emitted mimicking pre-defined directions the localized direct sound subbands S(i) are mixed into the output subbands such that the corresponding sound is emitted mimicking a direction determined by the corresponding direction factor A(i).

8. The method of claim 7 in which a sound is emitted mimicking a specific direction by applying the subband signal to the output subband corresponding to the loudspeaker most close to the specific direction.

9. The method of claim 7 in which a sound is emitted mimicking a specific direction by applying the same subband signal with different gains to the output subbands corresponding to the two loudspeakers directly adjacent to the specific direction.

10. The method of claim 7 in which a sound is emitted mimicking a specific direction by applying the same filtered subband signal with specific delays and gain factors to a plurality of output subbands to mimic an acoustic wave field.

11. The method of claim 1, in which the independent sound subbands N(i) the localized sound subbands S(i) and the direction factors A(i) are modified to control attributes of the reproduced virtual sound stage such width and direct to independent sound ratio.

12. The method of claim 1, in which all the method steps are repeated as a function of time.

13. The method of claim 12, in which the repetition rate of the processing is adapted to the specific input signal properties such as the presence of transients or stationary signal components.

14. The method of claim 1, in which the number of subbands and the respective subband bandwidths are chosen using the criterion of mimicking the frequency resolution of the human auditory system.

15. The method of claim 1, in which the input channels represent a stereo signal and the output channels represent a multi-channel audio signal.

16. The method of claim 1, in which the input stereo channels represent a matrix encoded surround signal and the output channels represent a multi-channel audio signal.

17. The method of claim 1, in which the input channels are microphone signals and the output channels represent a multi-channel audio signal.

18. The method of claim 1, in which the input channels are linear combinations of an Ambisonic B-format signal and the output channels represent a multi-channel audio signal.

19. The method of claim 1, in which the output multi-channel audio signal represents a signal for playback over a wavefield synthesis system.

20. An audio system, comprising:

an audio conversion device configured to perform operations of generating multiple output audio channels (y1, . . . , yM) from multiple input audio channels (x1, . . . , xL), in which the number of output channels is equal or higher than the number of input channels, the operations comprising:

using linear combinations of input subbands X1(i), . . . , XL(i), computing one or more independent sound subbands representing signal components, by removing from an input subband signal components which are also present in one or more of the other input subbands, the independent sound subbands representing signal components which are independent between the input subbands, using linear combinations of the input subbands X1(i), . . . , XL(i), computing one or more localized direct sound subbands representing signal components which are contained in more than one of the input subbands, and computing corresponding direction factors representing the ratios of the localized direct sound subbands representing signal components contained in two or more input subbands, generating the output subbands, Y1(i) . . . YM(i), comprising the steps of:

for each independent sound subband, selecting a subset of the output subbands, and scaling the corresponding independent sound subband, for each direction factor, selecting the subset of output subbands, and scaling the corresponding localized direct sound subband, and adding the scaled corresponding independent sound subband to the scaled corresponding localized direct sound subband, and converting the output subbands, Y1(i) . . . YM(i), to time domain audio signals, y1 . . . yM.

21. The audio conversion device of claim 20, in which the device is embedded in an audio car system.

22. The audio conversion device of claim 20, in which the device is embedded in a television or movie theater system.

* * * * *